US005090496A

United States Patent [19]

Walker

[11] Patent Number: 5,090,496

[45] Date of Patent: Feb. 25, 1992

[54] DOWN-HOLE BENT MOTOR HOUSINGS

[75] Inventor: Colin Walker, Belper, United Kingdom

[73] Assignee: Baroid Technology, Inc., Houston, Tex.

[21] Appl. No.: 758,265

[22] Filed: Aug. 26, 1991

Related U.S. Application Data

[63] Continuation of Ser. No. 542,912, Jun. 25, 1990.

[30] Foreign Application Priority Data

Jun. 28, 1989 [GB] United Kingdom ..... 8914799
Mar. 8, 1990 [GB] United Kingdom ..... 9005235

[51] Int. Cl.[5] ..... E21B 7/08

[52] U.S. Cl. ..... 175/61; 175/75; 285/178

[58] Field of Search ..... 175/61, 73, 75; 285/178

[56] References Cited

U.S. PATENT DOCUMENTS

| | | | |
|---|---|---|---|
| 4,653,598 | 3/1987 | Schuh et al. | 175/75 |
| 4,771,832 | 9/1988 | Bridges | 285/178 X |
| 4,772,246 | 9/1988 | Wenzel | 464/117 |
| 4,813,497 | 3/1989 | Wenzel | 175/74 |
| 4,817,740 | 4/1989 | Beimgraben . | |
| 4,834,719 | 5/1989 | Arenas | 285/178 X |
| 4,962,818 | 10/1990 | Delucia | 175/75 |

FOREIGN PATENT DOCUMENTS

| | | |
|---|---|---|
| WO8002582 | 11/1980 | PCT Int'l Appl. . |
| WO8702408 | 4/1987 | PCT Int'l Appl. . |
| 1235551 | 6/1971 | United Kingdom . |
| 14942 | 12/1977 | United Kingdom . |
| 1494273 | 12/1977 | United Kingdom . |
| 2026063 | 8/1982 | United Kingdom . |
| 2085055 | 7/1984 | United Kingdom . |

OTHER PUBLICATIONS

R. Feenstra et al., "A Technique for Continously Controlled Directional Drilling", 1984 Drilling Technology COnference, 11-27.

*Primary Examiner*—William P. Neuder
*Attorney, Agent, or Firm*—Browning, Bushman, Anderson & Brookhart

[57] ABSTRACT

A bent motor housing has a top end by which it is connected to the end of a drill string within a borehole and a bottom end on which a drill bit is mounted for drilling the borehole. A bend is provided intermediate the top and bottom ends for angularly offsetting the rotational axis of the drill bit relative to the longitudinal axis of the drill string to cause the drill bit to engage the wall of the borehole on one side. Furthermore a longitudinal bore provided for passage of a motor shaft extends from the top end to the bottom end of the housing and is concentrically disposed with respect to the top end and the bottom end but eccentrically disposed with respect to intermediate housing sections so as to form a stand-off portion in the vicinity of the bend for bearing against the wall of the borehole on the opposite side to that engaged by the drill bit so as to cause the angle of tilt Θ of the rotational axis of the drill bit relative to the axis of the borehole to exceed the angle of the bend in the housing.

20 Claims, 2 Drawing Sheets

DOWN-HOLE BENT MOTOR HOUSINGS

This is a continuation of copending U.S. application Ser. No. 07/542,912 filed on June 25, 1990.

BACKGROUND OF THE INVENTION

This invention relates to down-hole bent motor housings for use in drilling a borehole along a curve.

It is well known, in the field of directional drilling of boreholes, to drill a borehole along a curve using a mud motor having a bent housing for angularly offsetting the rotational axis of the drill bit relative to the longitudinal axis of the drill string so as to cause the drill bit to engage the wall of the borehole on one side and to thereby effect drilling along a curve whose curvature is determined by the angular offset of the bend in the housing. However, the angle of the bend in the housing is generally limited to about 1½° by the articulated motor shaft which extends through the housing to the drill bit.

Furthermore modern drilling methods can impose severe directional drilling demands which cannot be nlet by conventional bent housing mud motors. For example, in drilling a curved section of borehole in order to deflect the direction of the borehole from vertical (that is 0° inclination) to horizontal (that is 90° inclination), it may be necessary to increase the inclination of the borehole by, say, 12° for every hundred feet drilled. This degree of curvature cannot be attained using a conventional bent housing mud motor.

It is an object of the invention to provide a down-hole bent motor housing permitting directional drilling at an increased curvature.

According to the present invention, there is provided a down-hole bent motor housing for use in drilling a borehole along a curve, the housing being elongate and having a top end by which it is to be connected to the end of a drill string within the borehole, a bottom end on which a drill bit is to be mounted for drilling the borehole, a bend intermediate the top and bottom ends for angularly offsetting the rotational axis of the drill bit relative to the longitudinal axis of the drill string to cause the drill bit to engage the wall of the borehole on one side, and a longitudinal bore extending from the top end to the bottom end of the housing and provided for passage of a motor shaft, wherein the housing has a stand-off portion in the vicinity of the bend for bearing against the wall of the borehole on the opposite side to that engaged by the drill bit so as to cause the angle of tilt of the rotational axis of the drill bit relative to the axis of the borehole to exceed the angle of the bend in the housing.

The provision of the stand-off portion enables the angle of tilt of the rotational axis of the drill bit relative to the axis of the borehole to be increased relative to the angle of tilt obtainable using a conventional down-hole bent motor housing having a bend of the same angular offset. This increases the interference between the drill bit and the side of the borehole, as well as increasing the side force exerted by the drill bit on the formation being drilled, thus enabling a greater curvature to be obtained during drilling.

In a preferred embodiment of the invention the bore comprises a first rectilinear passage extending through a top portion of the housing and a second rectilinear passage extending through a bottom portion of the housing, the two passages meeting at the bend at an angle corresponding to the angular offset of the bend, and the provision of the stand-off portion bearing against the wall of the borehole resulting in the first passage being slightly inclined relative to the axis of the borehole in use.

Furthermore it is preferred that the housing comprises a top cylindrical housing part and a bottom cylindrical housing part, the two parts meeting at the bend at an angle corresponding to the angular offset of the bend, and the first and second passages extending respectively through the top and bottom housing parts and being coaxial therewith at least in the vicinity of the top and bottom ends of the housing.

Advantageously each of the top and bottom housing parts comprises a concentric housing section remote from the bend in which the associated passage is coaxially disposed and an eccentric housing section adjacent the bend in which the passage is eccentrically disposed so as to provide a thickened region of the housing wall, constituting said stand-off portion, on the side on which the housing bears against the wall of the borehole.

The eccentricity of the passage in the eccentric housing section of each of the top and bottom housing parts is preferably such that the thickness of the housing wall is at a maximum on the side on which the housing bears against the wall of the borehole and at a minimum on the diametrically opposite side, whereas the concentric housing section of each of the top and bottom housing parts has a wall thickness which is less than the minimum wall thickness of the associated eccentric housing section. Such an arrangement provides enhanced stiffness at the bend.

It is also preferred that the housing is formed from a single piece of metal by machining. This also increases structural rigidity.

In a development of the invention the bottom housing part is rotatable with respect to the top housing part to vary the angular offset, for example by means of an arrangement as described in British Patent No. 1494273.

The invention also provides a down-hole mud motor incorporating such a motor housing.

BRIEF DESCRIPTION OF THE DRAWINGS

In order that the invention may be more fully understood, a preferred embodiment of bent motor housing in accordance with the invention will now be described, by way of example with reference to the accompanying drawings, in which.

DETAILED DESCRIPTION OF THE DRAWINGS

Figure 1:
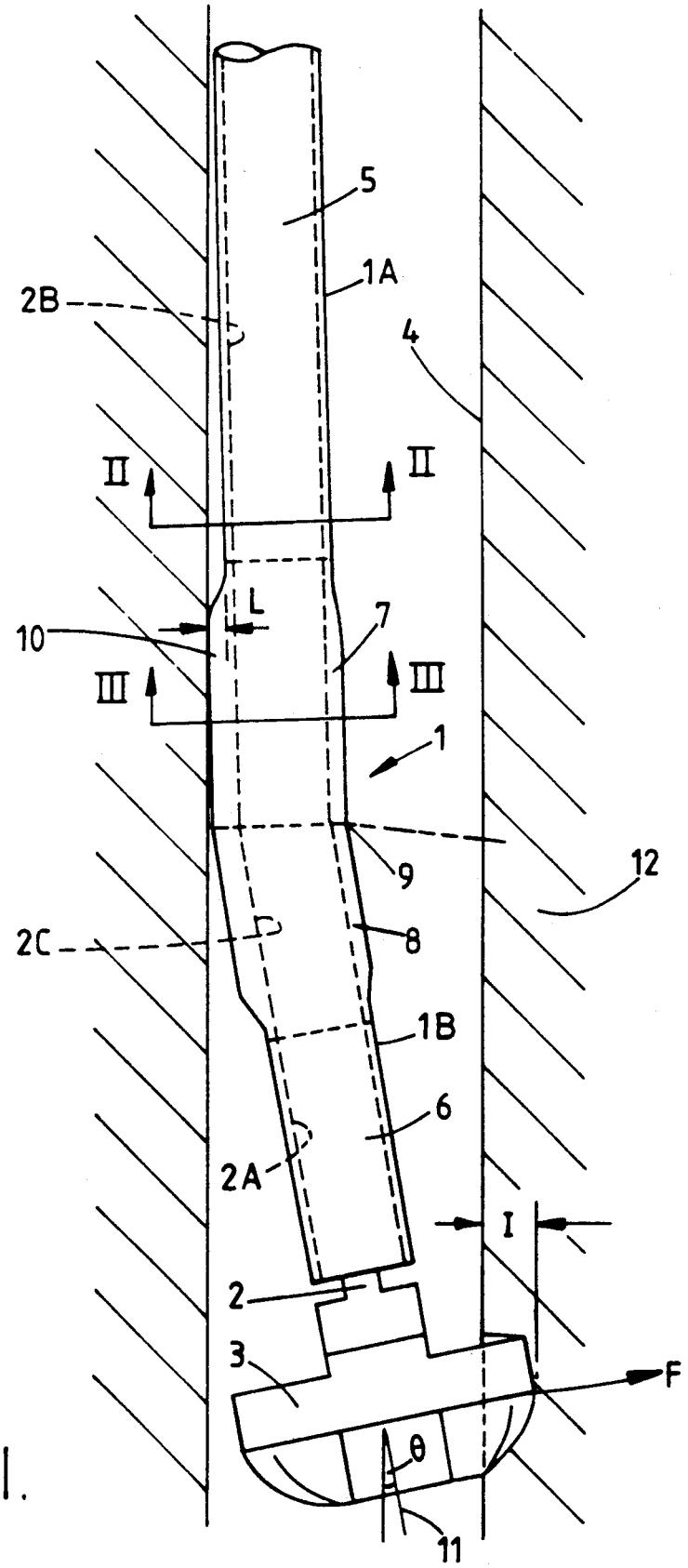
FIG. 1 diagrammatically shows the motor housing in use within a borehole.

Referring to FIG. 1 the bent motor housing 1 accommodates a drive shaft 2 extending through a longitudinal bore 2A in the housing, and a drill bit 3 is attached to the drive shaft 2 in the vicinity of a bottom end of the housing and is caused by the bend in the housing to engage one side of a borehole 4 extending through a formation 12 in order to drill along a curve in generally known manner. Although not shown in the figure, the top end of the housing is connected to the end of a drill string within the borehole 4 and houses the rotor of the motor which is coupled to the drill bit 3 by the drive shaft 2. The drive shaft 2 is articulated in order to enable it to accommodate the bend in the housing. Furthermore the drive shaft 2 is supported by thrust and radial bearings in the vicinity of the bottom end of the housing in known manner.

The housing 1 comprises a top cylindrical housing part 1A and a bottom cylindrical housing part 1B, the two parts 1A, 1B meeting at the bend 9 in the housing at an angle corresponding to the angular offset of the bend 9. Furthermore the bore 2A comprises a first rectilinear passage 2B extending through the top housing part 1A and a second rectilinear passage 2C extending through the bottom housing part 1B, the two passages 2B, 2C meeting at the bend 9 at an angle corresponding to the angular offset of the bend 9.

Figure 2:
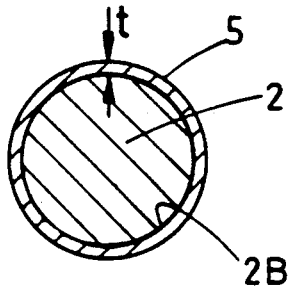
FIGS. 2 and 3 show diagrammatic cross sectional views on an enlarged scale along the lines II—II and III—III in FIG. 1.
Figure 3:
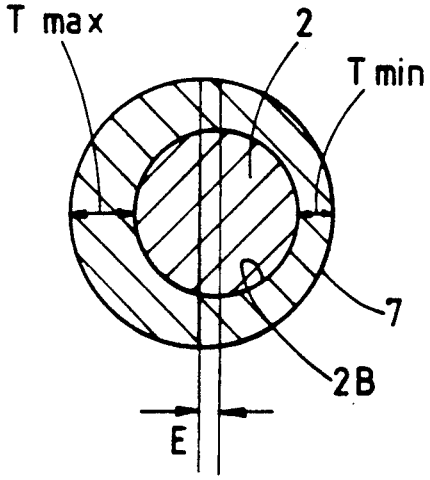

In addition the top housing part 1A comprises a conventionally configured concentric housing section 5 and an eccentric housing section 7, and the bottom housing part 1B comprises a conventionally configured concentric housing section 6 and an eccentric housing section 8. As shown in the cross-section of FIG. 2, the passage 2B is coaxially disposed with respect to the housing section 5, and similarly the passage 2C is coaxially disposed with respect to the housing section 6. However, as shown by the cross-section of FIG. 3, the passage 2B is eccentrically disposed with respect to the housing section 7, and similarly the passage 2C is eccentrically disposed with respect to the housing section 8.

It will be appreciated that the eccentric housing sections 7 and 8 have a greater outer diameter than the concentric housing sections 5 and 6, and furthermore that the eccentricity E of the passage 2B or 2C within the housing section 7 or 8 results in the thickness of the wall of the housing section 7 or 8 being at a maximum $T_{max}$ on the side on which the housing bears against the wall of the borehole 4 and at a minimum. $T_{min}$ on the diametrically opposite side. The wall thickness t of the concentric housing section 5 or 6 is constant and is less than the minimum wall thickness $T_{min}$ of the associated eccentric housing section 7 or 8.

Thus the thickened region of the housing wall on the side on which the housing bears against the wall of the borehole 4 constitutes a stand-off portion 10 producing a lateral offset L resulting in the passage 2B being slightly inclined relative to the axis of the borehole 4 so as to increase the angle of tilt of the rotational axis 11 of the drill bit 3 relative to the axis of the borehole 4 without increasing the angle of the bend 9 in the housing.

Thus, it will be appreciated that, if the bent motor housing 1 described above is used in place of a conventional bent motor housing of equal length and equal angular offset, the provision of the stand-off portion 10 will have the following effects:

1. Increase in the interference I between the drill bit 3 and the side of the borehole 4;

2. Increase in the side force F exerted by the drill bit 3 on the side of the borehole 4; and 3. Increase in the tilt angle T of the drill bit 3. These three effects mean that it is possible to increase the degree of curvature of the borehole being drilled to, for example, 12° or even 15° for every hundred feet drilled.

In addition, as the housing sections 7 and 8 are of greater diameter than the housing sections 5 and 6 and greater wall thickness, there is an associated increase in stiffness of the housing 1 in the vicinity of the bend 9, thus ensuring that the increased bending moment produced in the vicinity of the bend 9 by an increase in the side force F does not result in a decrease in the angular offset of the bend due to the reverse bending effect. This is important because the drive shaft 2 can be damaged in the vicinity of its articulated portion if reverse bending occurs beyond the permitted tolerances. Typically the flexural rigidity of the bend can be 50% higher than in a conventional bent motor housing.

It should be appreciated that the housing 1 is formed from a single piece of metal by machining both the inside and outside surfaces to form the housing sections 5 to 8, the bend 9 and the stand-off portion 10.

The increased stiffness at the bend is also advantageous in enabling a known control technique to be used in which a straight portion of the borehole is drilled by rotating the bent housing mud motor during drilling without overstressing the bent housing in such a way as to substantially decrease its service life. The substantial lateral forces to which the drill bit is subjected in such a technique are adequately compensated by the flexural rigidity of the bent housing. This technique avoids the time and cost which would otherwise be incurred by changing of the mud motor housing when it is required to drill a straight portion of the borehole immediately after drilling of a curved portion.

I claim:

1. A down-hole bent motor housing for use in drilling a borehole along a curve, the housing being elongate and having a top end by which it is to be connected to an end of a drill string within the borehole, a bottom end on which a drill is to be mounted for drilling the borehole, a bend intermediate the top and bottom end for angularly offsetting in a first radial direction the rotational axis of the drill bit relative to the longitudinal axis of the drill string to cause the drill bit to engage the wall of the borehole on the side of said first radial direction and to thereby drill the borehole toward the first radial direction, and a longitudinal bore extending from the top end to the bottom end of the housing and provided for passage of a motor shaft for rotatably driving the drill bit, wherein at least the portion of the housing in the vicinity of the bend has a thickened housing wall in a second radial direction opposing the first radial direction, said thickened housing wall constituting a stand off portion in the vicinity of the bend for bearing against the wall of the borehole on the opposite side to that engaged by the drill bit so as to cause the angle of tilt of the rotational axis of the drill bit relative to the axis of the borehole to exceed the angle of the bend in the housing.

2. A bent motor housing according to claim 1, wherein the bore comprises a first rectilinear passage extending through a top portion of the housing and a second rectilinear passage extending through a bottom portion of the housing, the two passages meeting at the bend at an angle corresponding to the angular offset of the bend, and the provision of the stand off portion bearing against the wall of the borehole resulting in the first passage being slightly inclined relative to the axis of the borehole in use.

3. A bent motor housing according to claim 2, wherein the housing comprises a top cylindrical housing part and a bottom cylindrical housing part, the two parts meeting at the bend at an angle corresponding to the angular offset of the bend; and the first and second passages extending respectively through the top and bottom housing parts and being coaxial therewith in the vicinity of the top and bottom ends of the housing.

4. A bent motor housing according to claim 3, wherein each of the top and bottom housing parts comprises a concentric housing section remote from the bend in which the associated passage is coaxially disposed and an eccentric housing section adjacent the bend in which the passage is eccentrically disposed so as to provide said thickened region of the housing wall, constituting said stand-off portion, on the side on which the housing bears against the wall of the borehole.

5. A bent motor housing according to claim 4, wherein the eccentricity of the passage in the eccentric housing section of each of the top and bottom housing parts is such that the thickness of the housing wall is at a maximum on the side on which the housing bears against the wall of the borehole and at a minimum on the diametrically opposite side.

6. A bent motor housing according to claim 5, wherein the concentric housing section of each of the top and bottom housing parts has a wall thickness which is less than the minimum wall thickness of the associated eccentric housing section.

7. A bent motor housing according to claim 1, wherein the housing is formed from a single piece of metal by machining.

8. A bent motor housing according to claim 1, having a bottom housing part which is rotatable with respect to a top housing part to vary the angular offset.

9. A bent motor housing according to claim 1, wherein the housing wall in the vicinity of the bend has a circular cross-section, and the longitudinal bore in the vicinity of the bend is eccentrically disposed with respect to said circular cross-section so as to provide said thickened housing wall.

10. A down-hole bent motor housing for use in drilling a borehole along a curve, the housing being elongate and having a top end for connection to a lower end of a drill string within the borehole and having an upper axis, and said housing having a bottom end for receiving an output shaft for mounting a drill bit to drill the borehole and having a lower axis, a bend intermediate the top end and the bottom end for angularly offsetting in a first radial direction the rotational axis of the output shaft relative to the upper axis of the top end of the housing to cause the drill bit to engage the wall of the borehole on the side of said first radial direction and to thereby drill the borehole toward the first radial direction, and a longitudinal bore extending from the top end through the bend and to the bottom end of the housing and providing a passage for a motor shaft to rotate the output shaft and the bit, at least a portion of the housing in the vicinity of the bend having a thickened wall region in in a second radial direction opposing the first radial direction, said thickened wall region constituting standoff portion adjacent the bend for bearing against the wall of the borehole on the side of said second radial direction so as to cause the angle of tilt of the output shaft relative to the axis of the borehole to exceed the angle of the bend in the housing.

11. A bent motor housing according to claim 10, wherein the bore comprises a first passage within the top end of the housing and a second passage within the bottom end of the housing, the first and second passages meeting at the bend at an angle corresponding to the angular offset of the bend.

12. A bent motor housing according to claim 11, wherein the top end of the housing comprises a top cylindrical housing part and the bottom end of the housing comprises a bottom cylindrical housing part, the top and bottom housing parts meeting at the bend at an angle corresponding to the angular offset of the bend, and the first and second passages each being coaxial with at least a portion of the top cylindrical housing part and bottom cylindrical housing part.

13. A bent motor housing according to claim 12, wherein each of the top and bottom housing parts comprises a concentric housing section spaced from the bend and having therein an associated coaxially disposed passage, and an eccentric housing section adjacent the bend and having therein an associated eccentrically disposed passage so as to provide the thickened region of the housing wall constituting the stand-off portion.

14. A bent motor housing according to claim 13, wherein the eccentricity of the passage in the eccentric housing section of each of the top and bottom housing parts is such that the thickness of the housing part is at a maximum on the side of said second radial direction, and is at a minimum on the side of said first radial direction.

15. A bent motor housing according to claim 14, wherein the concentric housing section of each of the top and bottom housing parts has a wall thickness which is less than the minimum wall thickness of the associated eccentric housing section.

16. A bent motor housing according to claim 10, wherein the top end of the housing and the bottom end of the housing are of a unitary construction and the bend angle is fixed.

17. A bent motor housing according to claim 10, wherein the bottom end of the housing is rotatable with respect to the top end of the housing to vary the angular offset.

18. A down-hole bent motor housing for drilling a borehole along a curve, the housing being elongate and having a top end for connection to a lower end of a drill string within a borehole and having an upper axis, and having a bottom end with an output shaft for mounting a drill bit to drill the borehole and having a lower axis, a bend intermediate the top end and the bottom end for angularly offsetting in a first radial direction the rotational axis of the output shaft relative to the upper axis of the top end of the housing to cause the drill bit to engage the wall of the borehole on the side of said first radial direction and to thereby, drill the borehole toward the first radial direction, and a longitudinal bore extending from the top end through the bend and to the bottom end of the housing for providing a passage for a motor shaft to rotate the output shaft and the bit, at least a portion of the housing in the vicinity of the bend having a circular cross-section and the passage in the vicinity of the bend being eccentrically disposed with respect to said circular said cross-section so as to provide a thickened region of the housing constituting a stand-off extending radially in a second direction opposing the first direction for bearing against the wall of the borehole on the side opposite to that engaged by the drill bit so as to cause the angle of tilt of the output shaft relative to the axis of the borehole to exceed the angle of the bend in the housing.

19. A bent motor housing as defined in claim 18, wherein the eccentricity of the passage through the bend with respect to the circular cross-section of the housing is such that the thickness of the housing wall is at a maximum on the side of said second radial direction, and is at a minimum on the side of said first radial direction.

20. A bent motor housing as defined in claim 18, wherein the top end of the housing and the bottom end of the housing are of a unitary construction and the bend angle is fixed.

* * * * *

UNITED STATES PATENT AND TRADEMARK OFFICE

CERTIFICATE OF CORRECTION

PATENT NO. : 5, 090,496

DATED : February 25, 1992

INVENTOR(S) : Colin Walker

It is certified that error appears in the above-identified patent and that said Letters Patent is hereby corrected as shown below:

In Column 4, line 27, after the word "drill" insert the word --bit--.

Signed and Sealed this

Eighteenth Day of May, 1993

*Attest:*

Michael K. Kirk

MICHAEL K. KIRK

*Attesting Officer*

*Acting Commissioner of Patents and Trademarks*